US007412928B2

(12) United States Patent
Combes et al.

(10) Patent No.: US 7,412,928 B2
(45) Date of Patent: Aug. 19, 2008

(54) ELECTRONIC SAFETY AND ARMING UNIT

(75) Inventors: David J Combes, Malvern (GB); David O King, Malvern (GB)

(73) Assignee: QinetiQ Limited, London (GB)

( * ) Notice: Subject to any disclaimer, the term of this patent is extended or adjusted under 35 U.S.C. 154(b) by 232 days.

(21) Appl. No.: 10/548,427

(22) PCT Filed: Mar. 5, 2004

(86) PCT No.: PCT/GB2004/000929

§ 371 (c)(1),
(2), (4) Date: Sep. 8, 2005

(87) PCT Pub. No.: WO2004/079290

PCT Pub. Date: Sep. 16, 2004

(65) Prior Publication Data

US 2006/0070547 A1 Apr. 6, 2006

(30) Foreign Application Priority Data

Mar. 8, 2003 (GB) ..... 0305414.5

(51) Int. Cl.
*F42C 15/34* (2006.01)

(52) U.S. Cl. ..... 102/222; 102/226; 102/254

(58) Field of Classification Search ..... 102/221, 102/222, 262, 226, 254
See application file for complete search history.

(56) References Cited

U.S. PATENT DOCUMENTS 5,705,767 A 1/1998 Robinson
5,902,953 A 5/1999 Lenko et al.

(Continued)

FOREIGN PATENT DOCUMENTS

EP 1 189 012 A 3/2002

(Continued)

OTHER PUBLICATIONS

International Search Report of PCT/GB2004/000929, mailed Jun. 4, 2004.

(Continued)

*Primary Examiner*—James S Bergin
(74) *Attorney, Agent, or Firm*—Nixon & Vanderhye P.C.

(57) ABSTRACT

An electronic safety and arming unit comprises a micro electromechanical system (MEMS) shutter device. The shutter (18) is suspended by thin lightweight arms and hinges, all formed by silicon processing of SOI substrates and includes holding latches for holding the shutter (18) in the closed position. The holding latches may be released by an electrothermal actuator. The shutter (18) separates an initiator section from an explosive train (6) of munitions such as shells, thereby providing safety until the shell is fired and away from its start point. After firing, the shutter (18) is opened ready for the main explosive to be detonated by the initiator (3). The shutter (18) may be suspended by a compliant displacement multiplier and may include an electrothermal actuator such as an electrically heatable bent beam. Heating of the beam causes movement of a shutter blade from a shut condition covering a firing aperture to an open condition. Alternatively the shutter (18) may operate by inertial centrifugal forces generated by a spinning munition. The shutter (18) may include latches for retaining the shutter in its open position.

20 Claims, 11 Drawing Sheets

U.S. PATENT DOCUMENTS

| | | | | |
|---|---|---|---|---|
| 6,173,650 | B1 | 1/2001 | Birk et al. | |
| 6,321,654 | B1 * | 11/2001 | Robinson | 102/251 |
| 6,431,071 | B1 * | 8/2002 | Hodge et al. | 102/254 |
| 6,568,329 | B1 * | 5/2003 | Robinson | 102/231 |
| 6,622,629 | B2 * | 9/2003 | Hodge et al. | 102/235 |
| 6,964,231 | B1 * | 11/2005 | Robinson et al. | 102/235 |

FOREIGN PATENT DOCUMENTS

| | | |
|---|---|---|
| GB | 1 283 914 | 8/1972 |
| GB | 2 025 005 A | 1/1980 |
| GB | 1 576 842 | 10/1980 |
| GB | 2 119 485 A | 11/1983 |

OTHER PUBLICATIONS

GB Search Report of GB 0305414.5, dated Dec. 1, 2003.

* cited by examiner

ELECTRONIC SAFETY AND ARMING UNIT

This application is the US national phase of international application PCT/GB2004/1000929, filed 5 Mar. 2004, which designated the U.S. and claims priority of GB 0305414.5, dated 8 Mar. 2003, the entire contents of each of which are hereby incorporated by reference.

The invention relates to an electronic safety and arming unit (ESAU) in which a safety mechanism is arranged between an initiator and an explosive section of a munition or rocket and the like.

Conventionally, munitions include a safety mechanism to prevent premature detonation of explosive material within the munitions during routine handling when loading into guns or launch tubes etc. as well as during the initial flight. Several known designs use clockwork or macro scale electromechanical safety systems.

One problem with prior art is related to size. Increasing demands for space in the fuse envelope for increased functionality mean that the space available for safety mechanisms is at a premium. Reducing the size of such a safety mechanism is therefore a priority.

One known arrangement suitable for miniaturisation uses sliding shutters as the safety mechanism to isolate an initiator section from the explosive train in munitions. This has problems with stiction occurring between contacting, movable parts. Assembling miniaturised sliders into guiding frames is also difficult.

The above problems are reduced, according to this invention, by the use of a suspended micro electromechanical system (MEMS) shutter device.

According to this invention, an electronic safety and arming unit arranged for use between an explosive train and an initiator section of munitions comprises:

a suspended micro electromechanical system shutter suspended resiliently above and covering a firing aperture in a closed position;

at least one hold latch arranged to prevent movement of the shutter until receipt of at least one electrical signal;

the shutter and at least one hold latch being arranged so that receipt of at least one electrical signal causes release of the at least one latch and allows movement of the shutter away from the firing aperture prior to operation of the initiator and detonation of the explosive train.

The unit may include an initiator having a flyer capable of being propelled through the firing aperture to the explosive train.

The initiator section may include an electronic foil initiator (EFI), a semiconductor bridge (SCB), a reactive bridge or a separate propellant charge and flyer.

A low voltage electrical micro heater may be included for initiation of a propellant charge.

The shutter may be attached to a compliant displacement multiplier and actuation arrangement so that receipt of an electrical signal causes movement of the shutter away from the firing aperture to allow operation of the initiator and detonation of the explosive train. Such actuation is advantageous in that it allows application of the device to unspun projectiles.

The hold latches may be controlled independent of one another so that the shutter is held closed until all latches are released. Each such release may be by operation of further electrothermally actuated devices such as bent beams. Each of the hold latches may be controlled from independent signals from independent environmental sensors, each sensor responding to a different aspect of the environment.

The compliant displacement multiplier may be a combination of electrothermal actuators, compliant hinges and armatures.

The shutter may be attached to a compliant support so that inertial centrifugal forces cause movement of the shutter away from the firing aperture to allow operation of the initiator and detonation of the explosive train.

The shutter may be a single component, or a double component with each covering about half of the firing aperture.

The electrothermal actuator may be a bent beam that deflects upon being heated, or a straight beam that extends upon heating to deflect a secondary beam.

The shutter, when in its closed position, is made robust enough to prevent the flyer from initiating the explosive train.

The shutter may further include a latch arrangement to hold the shutter in its open position after operation of the,actuation means. In the case of electrothermal actuation, this allows the shutter to remain open without a requirement for power.

In an electrothermally actuated device, the holding latch or latches may be used to allow storage of mechanical strain energy within the compliant hinge and leverage arrangement during activation of the electrothermal actuator. Such energy storage allows the shutter to open more rapidly and engage the latch more reliably to remain open.

In order to allow the shutter to survive the environment under which it must operate, the out of plane movement of the shutter may be constrained by a fixed substrate layer below, and a fixed capping layer above. Such an arrangement may be provided by known wafer scale packaging techniques. The in-plane movement of the shutter may be also be constrained by fixed supports and the at least one latch while the device is held in its closed position. When the shutter is in the open position its in-plane movement may be constrained by fixed supports and a further latch arrangement.

For some applications, two shutters may be employed in series and formed on a single wafer by replicating steps used in forming the first shutter to form the second shutter.

The shutter may also be used in other safety critical situations such as vehicle airbags, fire extinguishers etc.

Embodiments of the invention, given by way of example only, will now be described with reference to the accompanying drawing in which.

Figure 3:
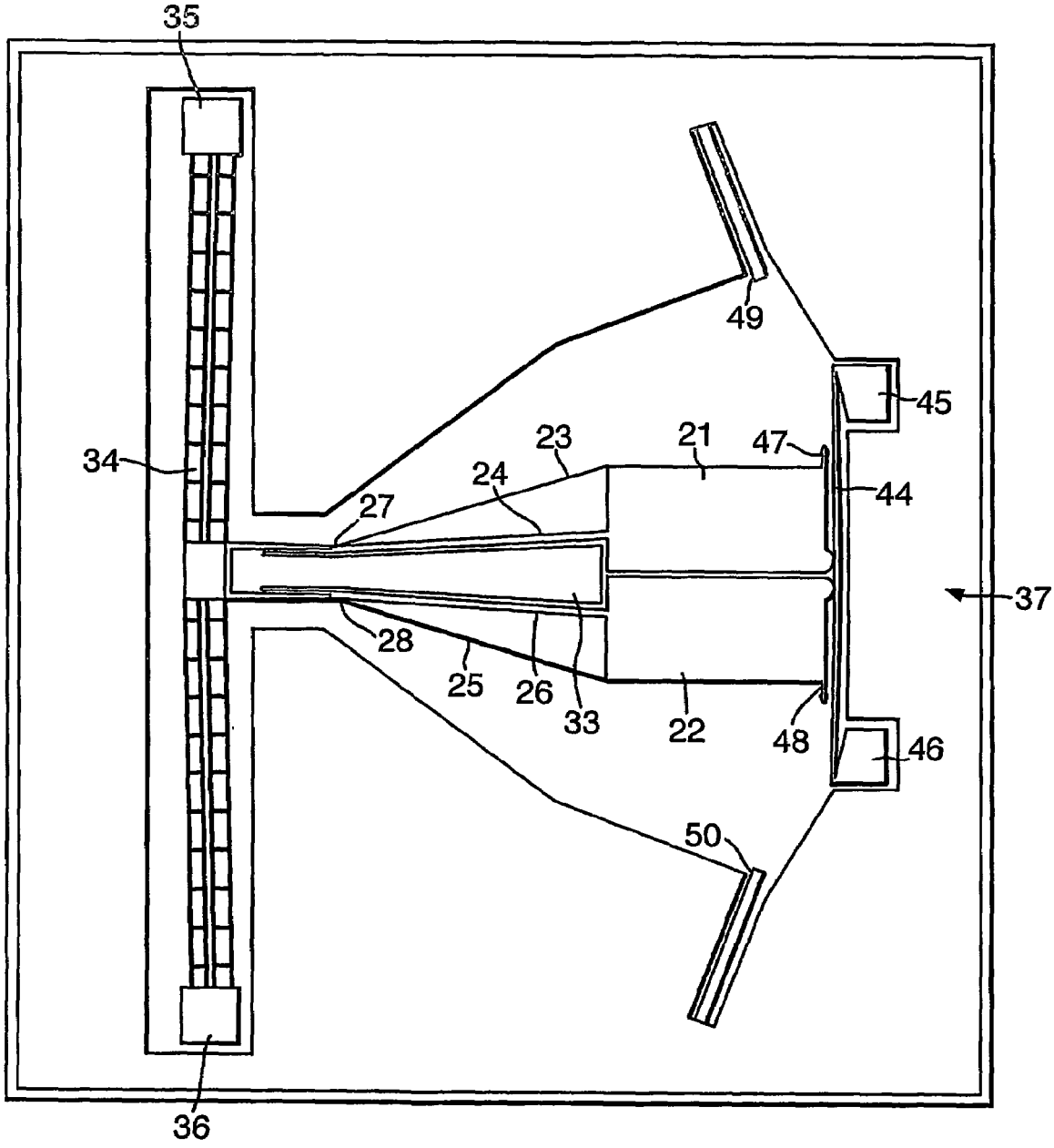
FIG. 3 shows a plan view of a double bladed shutter mechanism in its closed position and operable by a bent beam electrothermal actuator.
Figure 4A:
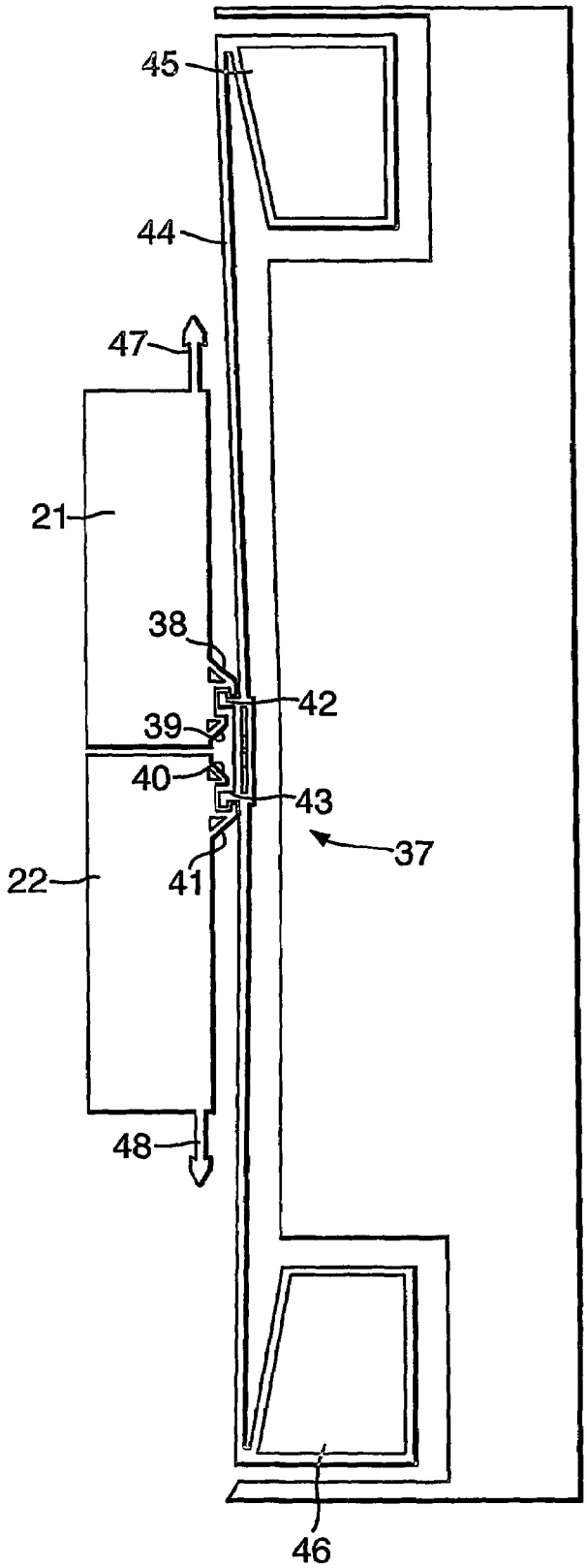
Figure 4B:
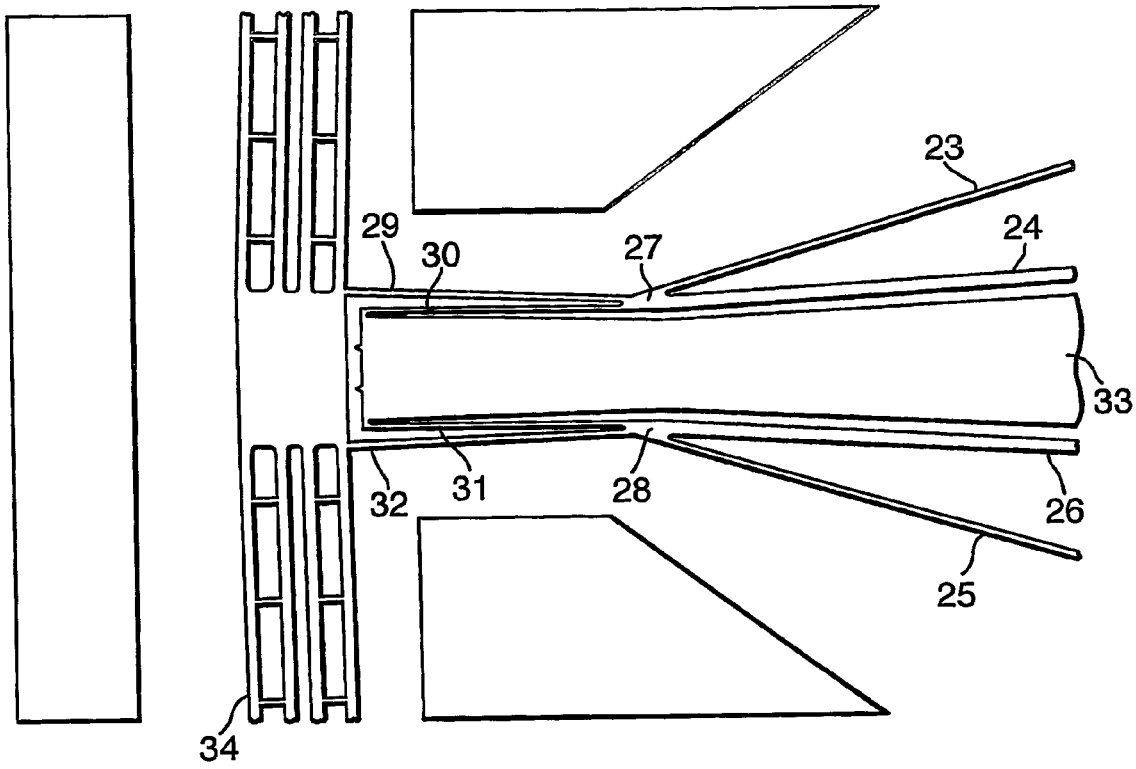
Figure 5:
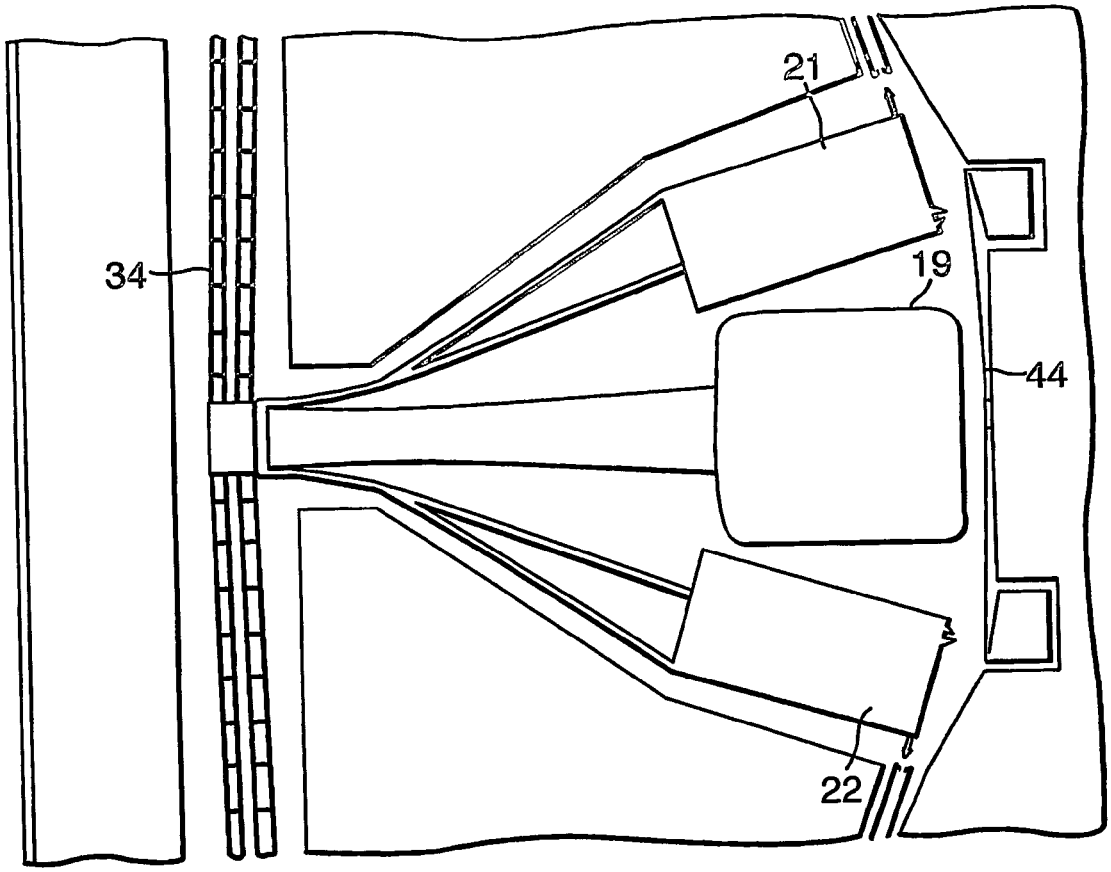
Figure 6:
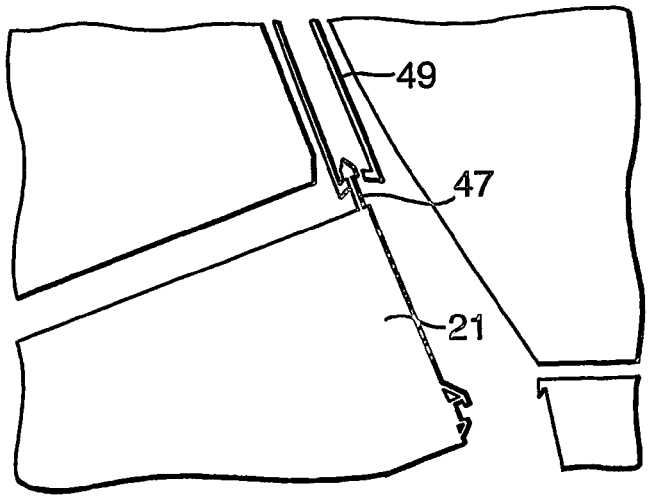
Figure 7:
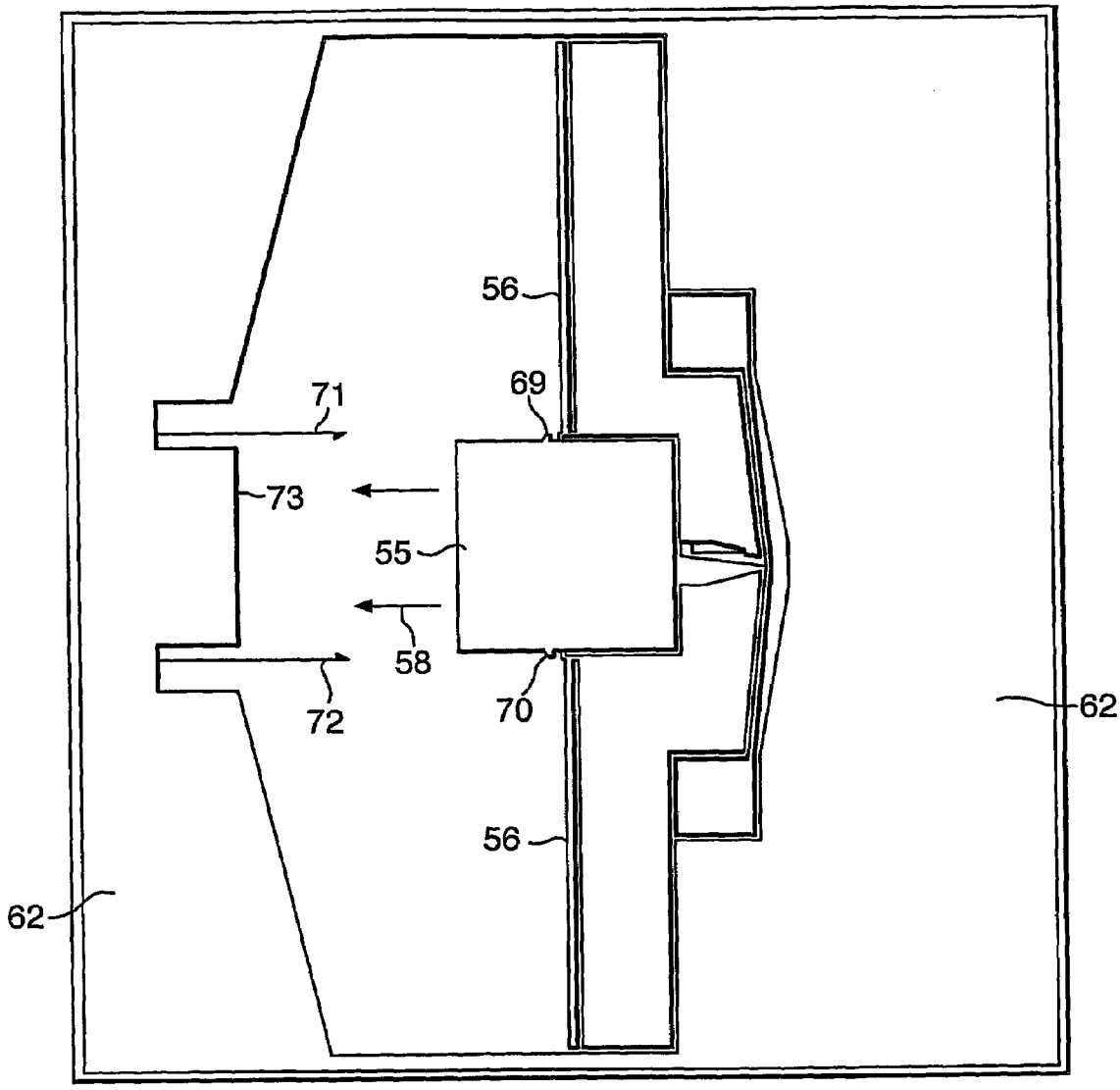
Figure 8:
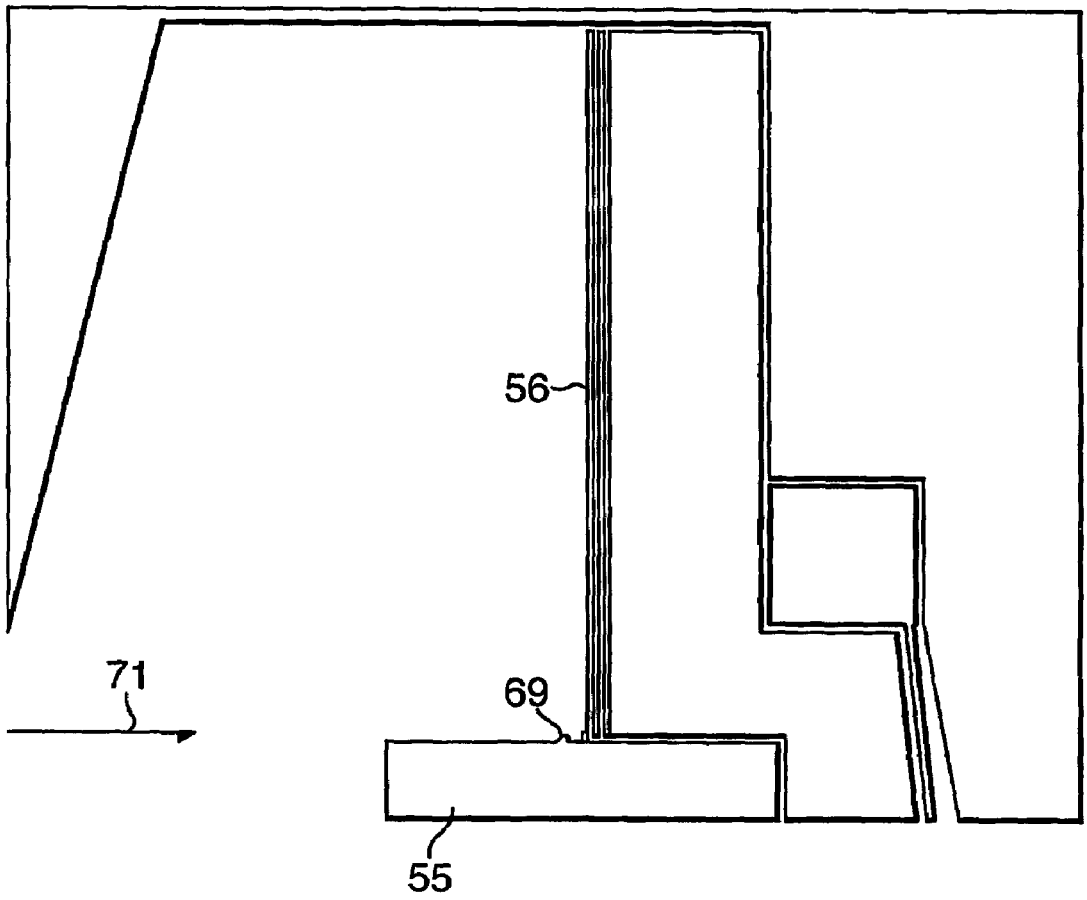
Figure 9:
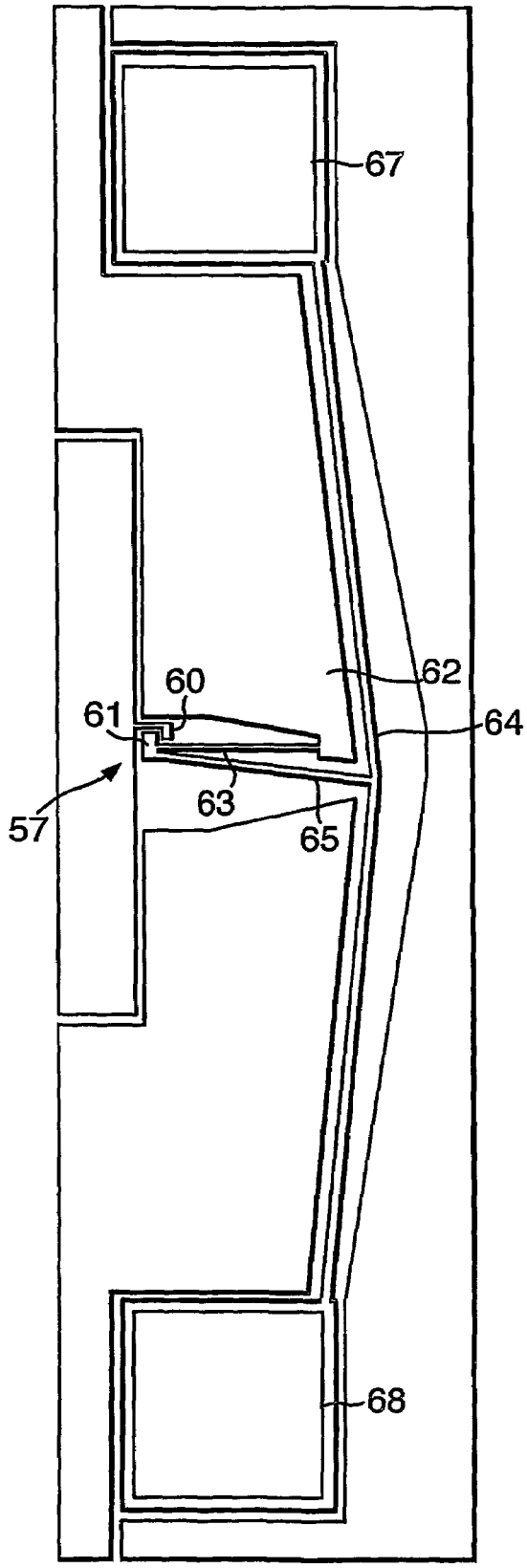

FIGS. 4*a, b* show parts of FIG. 3 to enlarged scale;

FIG. 5 shows the shutter of FIG. 3 in its open position;

FIG. 6 shows part of FIG. 5 to enlarged scale;

FIG. 7 shows another embodiment which uses the centrifugal acceleration of a spinning shell to move a shutter from a closed to an open condition;

FIG. 8 shows a suspending hinge in FIG. 7 to an enlarged scale;

FIG. 9 shows a holding latch in FIG. 7 to an enlarged scale;

FIGS. 10-14 show processing steps to make the devices of FIGS. 2-9.

Figure 14:
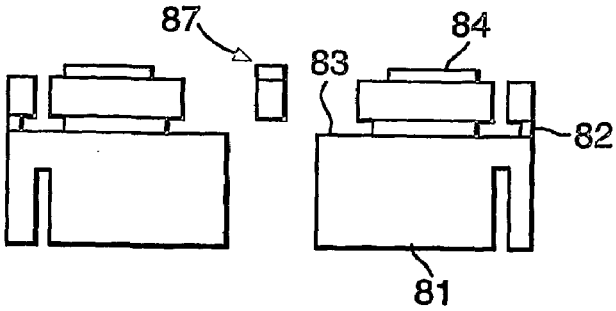
Figure 15:
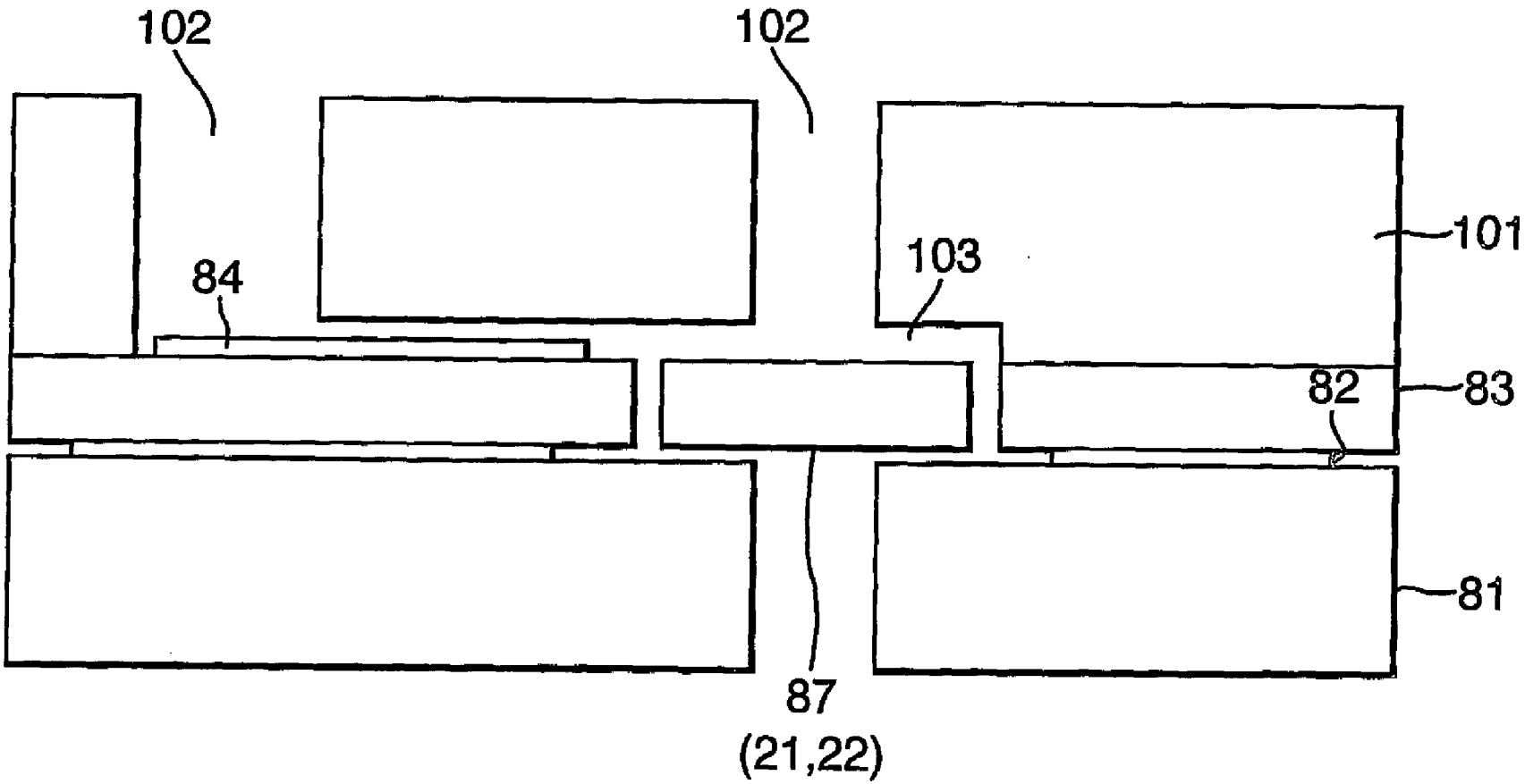

FIG. 15 shows an schematic cross section of a wafer scale packaged device, in which a cap wafer is added to the arrangement of FIG. 14.

Figure 16:
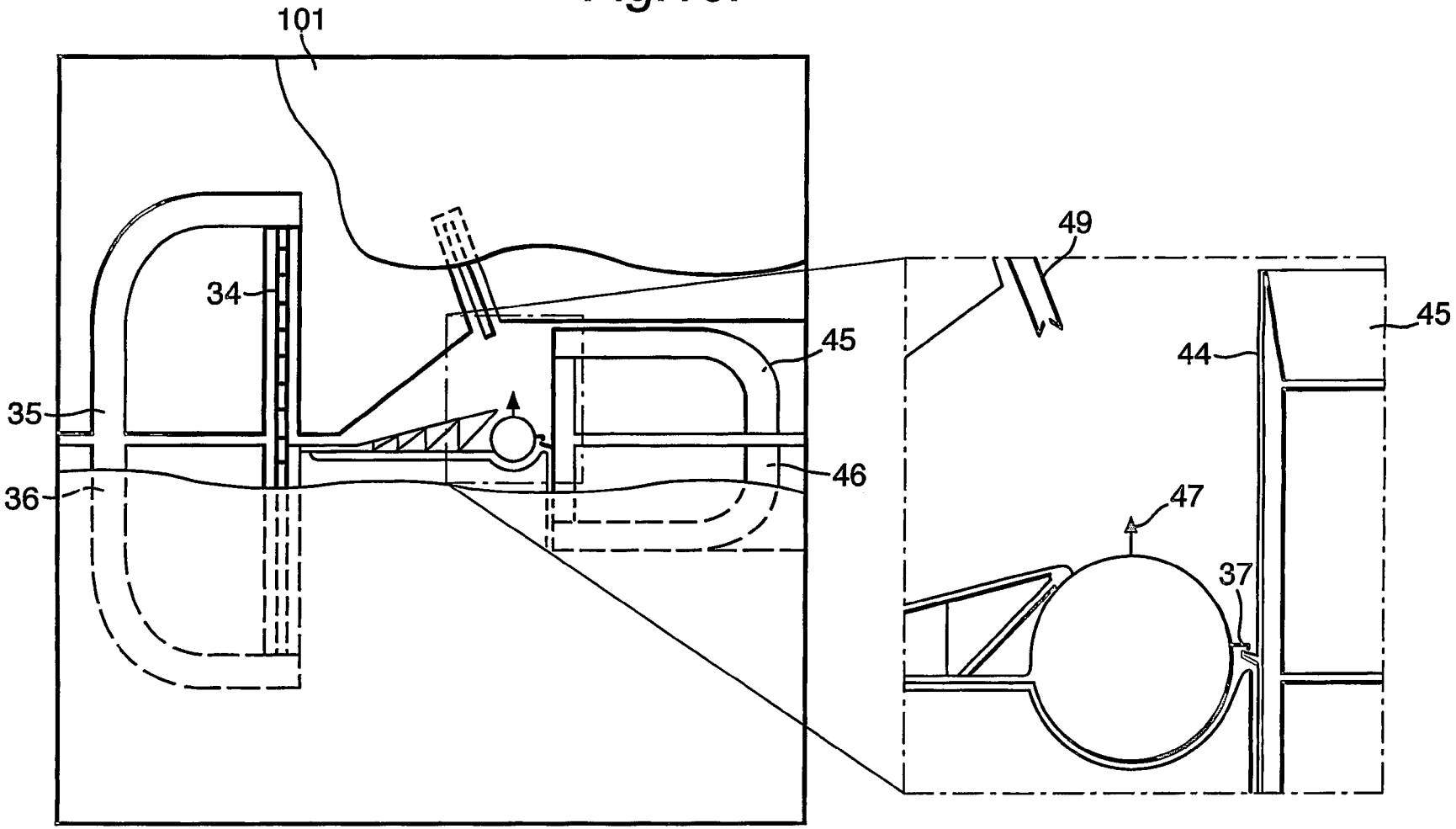

FIG. 16 shows a schematic example of an electrothermally actuated device designed for wafer scale packaging, and uses a single shutter blade.

Figure 1:
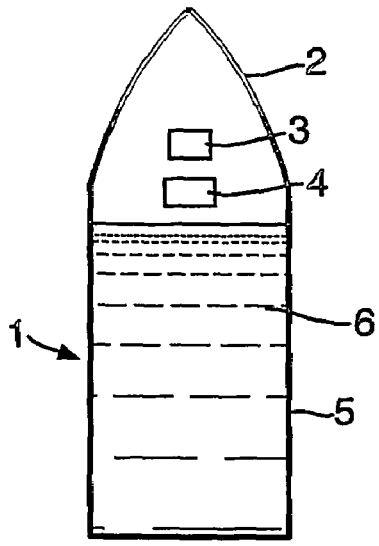
FIG. 1 shows a diagrammatic sectional view of a munition containing an electronic safety and arming unit adjacent an explosive train.

FIG. 1 shows a munition such as an artillery shell 1. The shell 1 comprises a fuse section 2 containing electronics 3, electronic safety and arming unit 4, and a main casing 5 containing an explosive train and main explosive 6. Not shown are set-back and spin sensors that have to operate after firing to allow the safety and arming unit to function subsequently.

Figure 2:
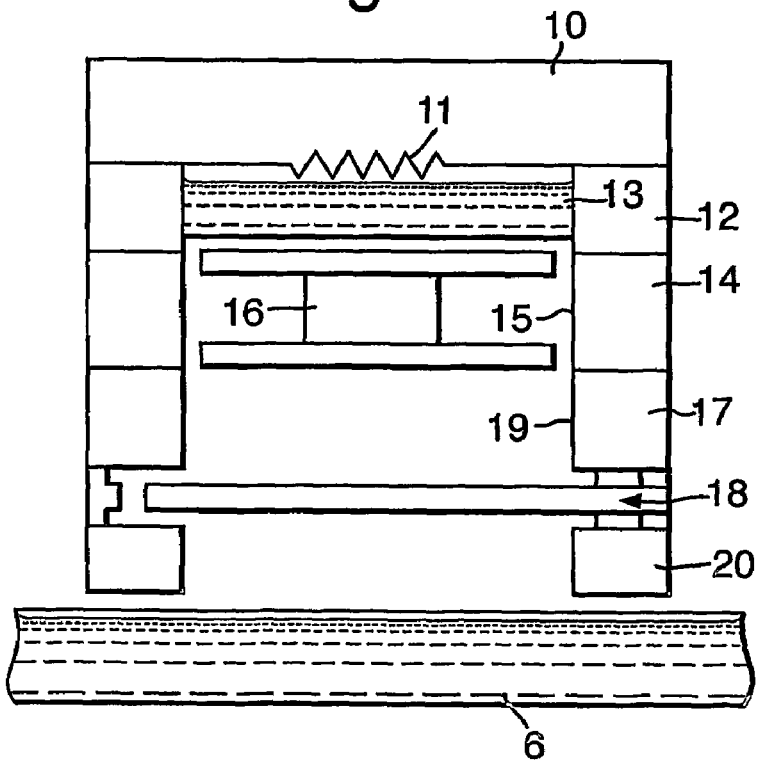
FIG. 2 shows an enlarged view of part of FIG. 1.

FIG. 2 shows the safety and arming unit 4 to an enlarged scale. It comprises, in serial order, a base layer 10 including an electrical heater element 11 on its top surface; a second layer 12 incorporating an initiator explosive or propellant 13; a third layer 14 having a bore 15 in which a flyer 16 slides; a fourth layer 17 which provides a base substrate for manufacture of shutter mechanism 18 and has a bore 19 along which the flyer 16 may slide; and a fifth capping layer 20 adjacent to the explosive train 6.

The flyer 16 is freely slidable along the bores 15, 19 but is restrained from initiating the explosive train 6 by the shutter 18 in its closed position. When the heater 11 is operated it causes the initiator explosive 13 to detonate or deflagrate thereby generating gas at a high pressure and propelling the flyer 16 towards the explosive train 6.

Alternatively the flyer may be formed during detonation or deflagration of the propellant 13 by tearing a planar layer around the edges of the bore to form a disc shaped flyer.

Alternatively a semiconducting bridge (SCB) device may be used to provide motive force for the flyer 16 in place of the electrical heater element 11 and initiator explosive 13. In this case electrical power would be used to vaporise an SCB element generating gas at high pressure and propelling the flyer towards the explosive train.

Alternatively an electronic foil initiator (EFI) device may be used to provide motive force for the flyer 16 in place of the electrical heater element 11 and initiator explosive 13. In this case electrical power would be used to vaporise a metallic element generating gas at high pressure and propelling the flyer towards the explosive train.

Alternatively a reactive bridge device may be used to provide motive force for the flyer 16 in place of the electrical heater element 11 and initiator explosive 13. In this case a combination of electrical power and chemical reaction energy would be used to vaporise a reactive element generating gas at high pressure and propelling the flyer towards the explosive train.

The shutter 18, in its closed position is capable of dissipating sufficient energy from the flyer 16 to prevent initiation of the explosive train to provide a safety condition should the initiator be fired accidentally. When the shutter 18 is caused to open, upon deflagration or detonation of the initiator explosive 13, the flyer 16 travels at high speed along the bores 15, 19 to impact on and detonate the explosive train 6.

The shape and operation of one example of shutter is shown in FIGS. 3-6. The shutter 18 is formed by two blades 21, 22 each mounted on two thin arms 23, 24 and 25, 26 connected by a compliant hinge point 27, 28 (FIG. 4*b*). The compliant hinge points 27, 28 are themselves mounted on the ends of two hinge levers 29, 30 and 31, 32, one connected to an anchor part of a base plate 33 and the other connected to a bent beam electrothermal actuator 34. Contact pads 35, 36 at the fixed ends of the thermal beam 34 allow an electrical current to be applied to the beam 34 causing a heating and consequential bending. The beam 34 is formed with a slight bend so that it bends predictably to one side during heating. The combination of arms 23-26, hinge points 27, 28, hinge levers 29-32, anchor 33 and bent beam 34 forms a compliant displacement multiplier and actuation arrangement.

Holding latches 37 (FIG. 4*a*) are arranged to hold the two blades 21, 22 in a closed position. These holding latches 37 are formed by spurs 38, 39 and 40, 41 on the blades 21, 22 respectively and hooks 42, 43 carried on a second thermal beam 44. The ends of this second beam are fixed to the base 33 and carry contact pads 45, 46 through which an electrical current may be applied to heat the beam 44 to its bent position.

As shown more clearly in FIGS. 5 and 6, each blade 21, 22 also carry a hook 47, 48 engagable with a respective latch 49, 50 when the blades 21, 22 are separated forming an open shutter.

Operation of the shutter is as follows: The blades 21, 22 start in close proximity with one another and with the holding latches 37 in a holding condition; this is the shutter closed condition. An electric current is applied to the bent beam 34 causing its extension and bending. Such bending applies force to the hinge levers 29, 30 and 31, 32 trying to separate the blades 21, 22 which remain together under the retaining action of the holding latches 37. The second thermal beam 44 is then heated by an electric current causing bending of the beam 44 and release of the holding latches 37. As a result, the blades move apart quickly under the stored forces in the hinge levers 29, 30, and 31, 32 plus the continuing bending of the thermal beam 34. The effect is to force the blades 21, 22 apart until they engage the latches 49, 50 which hold them against returning to a closed position.

After such an opening, the initiator 13 may be ignited forcing the flyer 16 at high speed through the open shutter 18 into impact with the explosive train 6 and its resultant detonation.

The shutter may take other forms and shapes. All such variants have the common feature of a one or more piece shutter blade suspended by thin arms, levers or springs, with movement controlled by the effect of an electrical signal.

Other form of the shutter actuation means may derive motive force from the inertial centrifugal acceleration of components within a spun shell. For example the shutter of FIG. 3 (after some modifications) could dispense with the thermal beam 34 and the blades 21, 22 could open under centrifugal acceleration after the holding latches are released.

Another example of a centrifugal acceleration actuated shutter mechanism is shown in FIG. 7 and FIGS. 8, 9 to a larger scale. In this case the shutter 55 is mounted on springs 56, 57 which are compliant in the direction 58 of required movement, and the device aligned so that the inertial acceleration acts in the appropriate direction. As shown the shutter blade 55 is held in its closed position by a holding latch 59 formed by a spur 60 on the blade engaging with a hook 61. The hook 61 is attached to a base anchor 62 through a thin arm 63, and to a bent beam actuator 64 through a lever 65. The ends of the bent beam 64 are attached to the base 66 at electrical connection pads 67, 68.

The blade 55 also carries two further spurs 69, 70 arranged to be retained by two hooks 71, 72 to hold the blade in its open condition against a stop 73.

When the munition 1 is fired and is clear from the launch area and spinning freely, a current may be applied to the bent beam 64. The bent beam 64 applies force to the compliant arm 63 and lever 65 arrangement which moves the hook 61 free of the spur 60. The shutter 55 is then free to move under inertial force until it meets the stop 73 and engages the latches 71, 72 which hold the shutter 55 against returning to a closed position.

The devices of FIGS. 2 to 9 may be made by the SOI processing steps shown in FIGS. 10-14.

Figure 10:
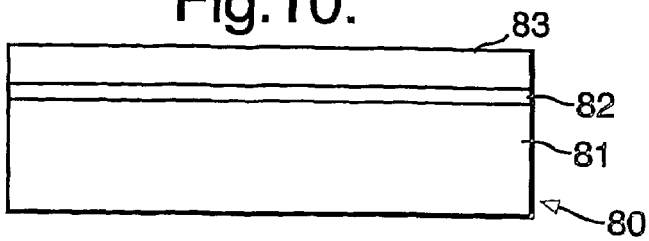

The silicon on insulator process (SOI) process is started as in FIG. 10 with a standard e.g. 15 cm diameter wafer 80 having a 500 μm thick base 81 of Si, a 4 μm thick buried oxide layers 82, and a 100 μm thick device Si layer 83. The Si may be 3 mgΩ-cm+/−10% (Boron doped).

Figure 11:
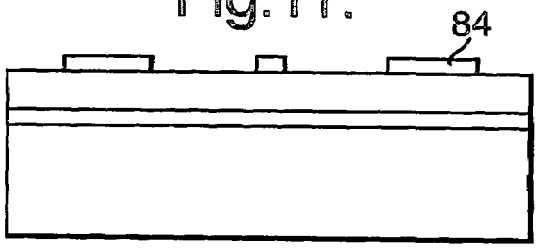

FIG. 11. A layer 84 of metal is formed and its features defined, e.g. by deposition of a metal layer (TiW/Al or alloy/TiW), photolithography, and etch. This material will subsequently form the contact pads 35, 36, 45, 46, 67, 68 and any necessary conducting tracks.

Figure 12:
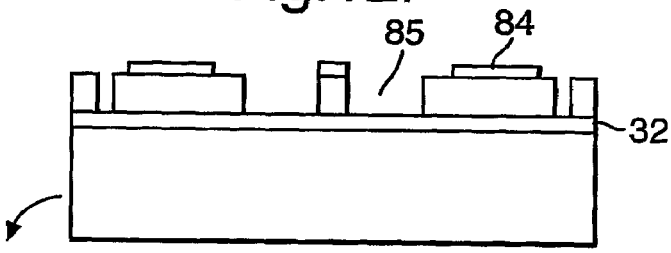

FIG. 12. Define aperture 86 (the bore 19 of FIG. 2) in base 81 to allow communication of flyer initiator. This is done, after protecting the front with a hard oxide layer, by a deep dry etch stopping at the buried oxide layer 82. Scribe lines may be etched at the same time part through.

Figure 13:
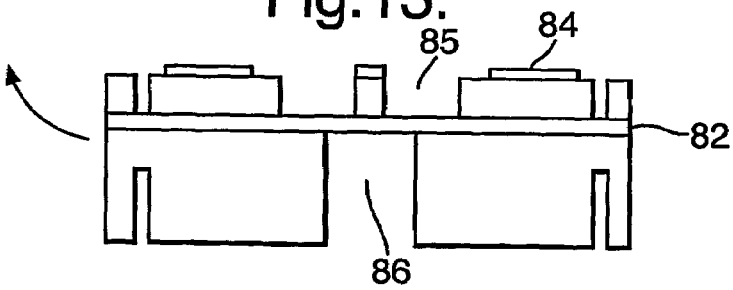

FIG. 13. Define MEMS electrothermal actuators and shutter in the device layer 83 by photolithography, and a deep dry etch 85 stopping at the buried oxide layer 82. A scribe line may be etched simultaneously so that the individual devices may be separated later.

FIG. 14. Release the suspended MEMS components e.g. shutter 18, blades 21, 22 etc. of FIGS. 2, 3, by an HF based timed etch of the buried oxide layer 82, followed by a solvent rinse and dry bake step. If wafer scale packaging is to be used, to avoid debris at the bond interface with the packaging layer it may advantageous to delay release of the suspended components until the package layer is bonded to the device. Under such circumstances it may be preferable to use a vapour phase hydrofluoric acid release process.

The movable MEMS components of e.g. FIG. 3, shutter blades 21, 22, arms 23-26, hinges 29-32, bent beams 34, 44, latches 37, 48, 49 etc. are formed by the device silicon layer 83 shown as a single piece 87 in FIG. 14 suspended above the original buried oxide layer 82. The contact electrodes are formed by the metal pads 84.

As noted above, a typical thickness for the MEMS movable components of FIG. 3 is 100 μm, the shutter blades 21, 22 are about 1 mm, the two parts of the bent beam 34 are about 20 μm wide, the components of the compliant hinges 27, 28 are about 10 μm wide. Full deflection of the shutter blades 21, 22 from the closed condition of FIG. 3 to the open condition of FIG. 5 by electrothermal actuation uses around 1.5 W and the thermal time constant for the system is around 10 ms. For a 15 cm diameter wafer, this results in about 150 devices per wafer, after the wafer has been diced into individual devices. Such devices are readily mounted into the electronic safety and arming unit 4 of FIGS. 1, 2 without the complicated and difficult assembly required for many prior art devices.

FIG. 15 shows a schematic sectional view of a device which adds a caping layer 101 to the device of FIG. 14, like components have been given like reference numerals in both Figures. The cap layer is wafer scale packaged by direct silicon bonding of a cap wafer 101 to the device SOI layer 83 before the two complete wafers have been diced into individual devices. Prior to bonding the capping wafer is processed with holes 102 to allow communication (e.g. for the flyer initiator or electrical connections to the metal layer). The capping wafer is further processed with a recess 103 to allow the moving parts in the device layer 83 (e.g. the shutter etc. 21, 22) to be constrained in out of plane movement in the direction of the capping wafer. The substrate layer 81 constrains the motion of the moving parts in the other direction out of plane.

FIG. 16 shows a schematic example design for an electrothermally actuated shutter with a capping wafer 101. It has one blade 110, and includes a latch 37 to hold the shutter in its closed position and a further latch 47, 49 to hold the device in its open position. Metal tracks 35, 36, 45, 46 are used ensure electrical communication holes can be made on the edge of the die to enable easy access.

The invention claimed is:

1. A miniature electronic safety and arming unit fabricated using micro electromechanical system technology, arranged for use between an explosive train and an initiator of munitions comprising:

a suspended shutter suspended above and covering a firing aperture in a closed position;

at least one hold latch arranged to prevent movement of the shutter until receipt of an electrical signal; and the shutter and hold latch being arranged so that receipt of an electrical signal causes release of the at least one hold latch and allows movement of the shutter uncovering the firing aperture prior to operation of the initiator and detonation of the explosive train.

2. The unit of claim 1 wherein the shutter is attached to a compliant displacement multiplier and actuation arrangement so that receipt of an electrical signal causes movement of the shutter away from the firing aperture.

3. The unit of claim 2 wherein the compliant displacement multiplier is a combination of electrothermal actuators, compliant hinges, arms and levers.

4. The unit of claim 1 wherein the shutter is attached to a compliant support arranged so that inertial centrifugal forces cause movement of the shutter away from the firing aperture to allow operation of the initiator and detonation of the explosive train.

5. The unit of claim 1 wherein shutter includes at least one blade movable to cover and uncover the firing aperture.

6. The unit of claim 1 wherein the shutter includes a latch arrangement to hold the shutter in its open position after operation of the actuation means.

7. The unit of claim 1 wherein the shutter includes at least one holding latch arrangement to hold the shutter in its closed position until released.

8. The unit of claim 7 wherein the holding latch arrangement is releasable by a further electrothermally actuated device.

9. The unit of claim 7 wherein the at least one holding latch arrangement comprises two independent latches, arranged such that each releases in response to an independent signal from an independent environmental sensor.

10. The unit of claim 9 wherein each environmental sensor controlling each holding latch responds to a different aspect of the environment.

11. The unit of claim 1 wherein the shutter is constrained to small movements in the out of plane direction by a substrate layer and a capping layer.

12. The unit of claim 11 wherein the capping layer is formed by means of wafer scale packaging.

13. The unit of claim 1 wherein the device is packaged by wafer scale packaging.

14. The unit of claim 1 wherein the initiator is provided as an integral component of said unit.

15. The unit of claim 14, wherein said initiator comprises a flyer capable of being propelled through the firing aperture to the explosive train.

16. The unit of claim 14 wherein the initiator comprises a separate propellant charge and flyer.

17. The unit of claim 14 wherein the initiator comprises an electronic foil initiator.

18. The unit of claim 14 wherein the initiator comprises a semiconductor bridge.

19. The unit of claim 14 wherein the initiator comprises a reactive bridge.

20. The unit of claim 14, wherein said initiator comprises a low voltage electrical micro heater for initiation of a propellant charge in the initiator.

* * * * *